US006550160B2

(12) United States Patent
Miller, II

(10) Patent No.: US 6,550,160 B2
(45) Date of Patent: Apr. 22, 2003

(54) METHOD AND DEVICE FOR ORIENTING THE FOOT WHEN PLAYING GOLF

(76) Inventor: Eugene T. Miller, II, 103 Elbow La., Fort Washington, PA (US) 19034

( * ) Notice: Subject to any disclaimer, the term of this patent is extended or adjusted under 35 U.S.C. 154(b) by 0 days.

(21) Appl. No.: 09/935,306

(22) Filed: Aug. 23, 2001

(65) Prior Publication Data

US 2001/0054242 A1 Dec. 27, 2001

Related U.S. Application Data

(63) Continuation-in-part of application No. 09/523,941, filed on Mar. 13, 2000, now abandoned.

(51) Int. Cl.[7] ..... A43B 5/00
(52) U.S. Cl. ..... 36/127; 36/144; 36/29
(58) Field of Search ..... 36/127, 29, 144, 36/143

(56) References Cited

U.S. PATENT DOCUMENTS 1,605,985 A * 11/1926 Rasmussen ..... 36/153
2,365,807 A * 12/1944 Dialynas ..... 36/153
4,358,902 A * 11/1982 Cole et al. ..... 36/28
4,744,157 A * 5/1988 Dubner ..... 36/117.6
4,934,072 A * 6/1990 Fredericksen et al. ..... 36/153
5,179,792 A * 1/1993 Brantingham ..... 36/29
5,313,717 A * 5/1994 Allen et al. ..... 36/153
5,797,200 A * 8/1998 Hess et al. ..... 36/51
5,846,063 A * 12/1998 Lakic ..... 2/413

* cited by examiner

*Primary Examiner*—Ted Kavanaugh
(74) *Attorney, Agent, or Firm*—LaMorte & Associates

(57) ABSTRACT

A shoe device that is useful in obtaining the proper stance when playing the game of golf. The shoe device has a sole section, wherein the sole section has a left side and a right side. The shoe also includes an upper section that is coupled to the sole section. The upper section is sized to receive a foot. The upper section has a right side area that is disposed above the right side of the sole and a left side area that is disposed above the left side of the sole. A slanting mechanism is disposed within the shoe for selectively slanting the sole section of the shoe so that either the right side area or the left side area is elevated to a height above the opposite area. By slanting the shoe to one side, a golfer is reminded to keep his/her weight the inside of their right foot when swinging a golf club, thereby making for a better swing.

7 Claims, 4 Drawing Sheets

METHOD AND DEVICE FOR ORIENTING THE FOOT WHEN PLAYING GOLF

RELATED APPLICATIONS

This application is a Continuation-In-Part of U.S. patent application Ser. No. 09/523,941 filed Mar. 13, 2000 abandoned.

BACKGROUND OF THE INVENTION

1. Field of the Invention

The present invention relates to shoes that contain some device for orienting the feet in a particular manner for training purposes. More particularly, the present invention relates to devices that train a person to properly orient their feet when playing golf.

2. Statement of the Prior Art

There are many devices in the prior art record that are used to help a person train to play a particular sport. Many such prior art devices are used to help train a person to properly orient both their body and their feet for a stance that is appropriate for the sport being played.

Few sports have more training aids than does golf. In the game of golf, golfers are always trying to improve their swing. When swinging a golf club, many factors contribute to the quality of the swing. For instance, the way a person stands, the position of a person's arms, the way the club is grasped and the dynamics of the swinging motion all contribute to the quality of the swing. As a person practices golf, they usually concentrate upon one aspect of the swing at a time. Different training aids exist to help people perfect specific aspects of their swing.

One aspect of a golf swing that must be perfected is the proper foot stance and how to maintain that proper foot stance throughout the swing. During a golf swing, a golfer transfers his/her weight from one foot to the other. During the swing, a golfer is supposed to maintain his/her weight on the inside portion of the right leg as a person transfers their weight from the right leg to the left leg. Over the years there have been many different training aids that have been used to help a person keep their weight on the inside portion of their right foot during a swing. When being instructed by a professional, right handed golf students are often required to step on a golf ball or another small object with the outer portion of their right foot. This elevates the outer portion of the foot and forces the golfer to swing with their weight on the inside portion of their right foot. After enough practice, a golfer learns the feel of their right foot during the swing and no longer requires the elevating device.

Placing your weight on only one side of your foot is an unnatural activity. As such, golfers often forget and stand flat footed as they swing. The result is a less than ideal swing. When out on a course, playing golf, it is not practical to place an object under your foot each time you swing the golf club. Due to changes in surface contours and surface type, a person often changes the position of his/her feet several times prior to swinging. Using prior art techniques, a person would have to relocate an object under their shoe each time they moved their feet. As a result, the use of foreign objects under the golfer's shoe is mostly used when practicing and is seldom used during actual play.

A need therefore exists for a device that can be used by a golfer when playing golf on the course that helps a golfer keep their weight on the inside of their foot as they golf. This need is met by the present invention as it is described and claimed below.

SUMMARY OF THE INVENTION

The present invention is a shoe device that is useful in obtaining the proper stance when playing the game of golf. The shoe device has a sole, wherein the sole has a left side and a right side. The shoe also includes an upper section that is coupled to the sole. The upper section of the shoe is sized to receive a foot. The upper section has a right side area that is disposed above the right side of the sole and a left side area that is disposed above the left side of the sole.

A mechanism is disposed within the shoe for selectively slanting the one side of the shoe so that the one side of the foot is elevated to a height above the opposite side of the foot within the shoe. By slanting the shoe from right to left, a right handed person is reminded to keep his/her weight on the left side of their right foot when swinging a golf club, thereby making for a better swing. For a left handed person, the left shoe is slanted from left to right.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE INVENTION

Although the present invention can be used in conjunction with any type of shoe, such as a sneaker or other casual shoe, the present invention is particularly well suited for use with golf shoes. Accordingly, the present invention will be described in conjunction with a golf shoe in order to set forth the best mode contemplated for the invention. The golf shoe described is a right shoe for use by a right-handed golfer. It will be understood that the invention as described can be applied to a left shoe for a left-handed golfer.

Figure 1:
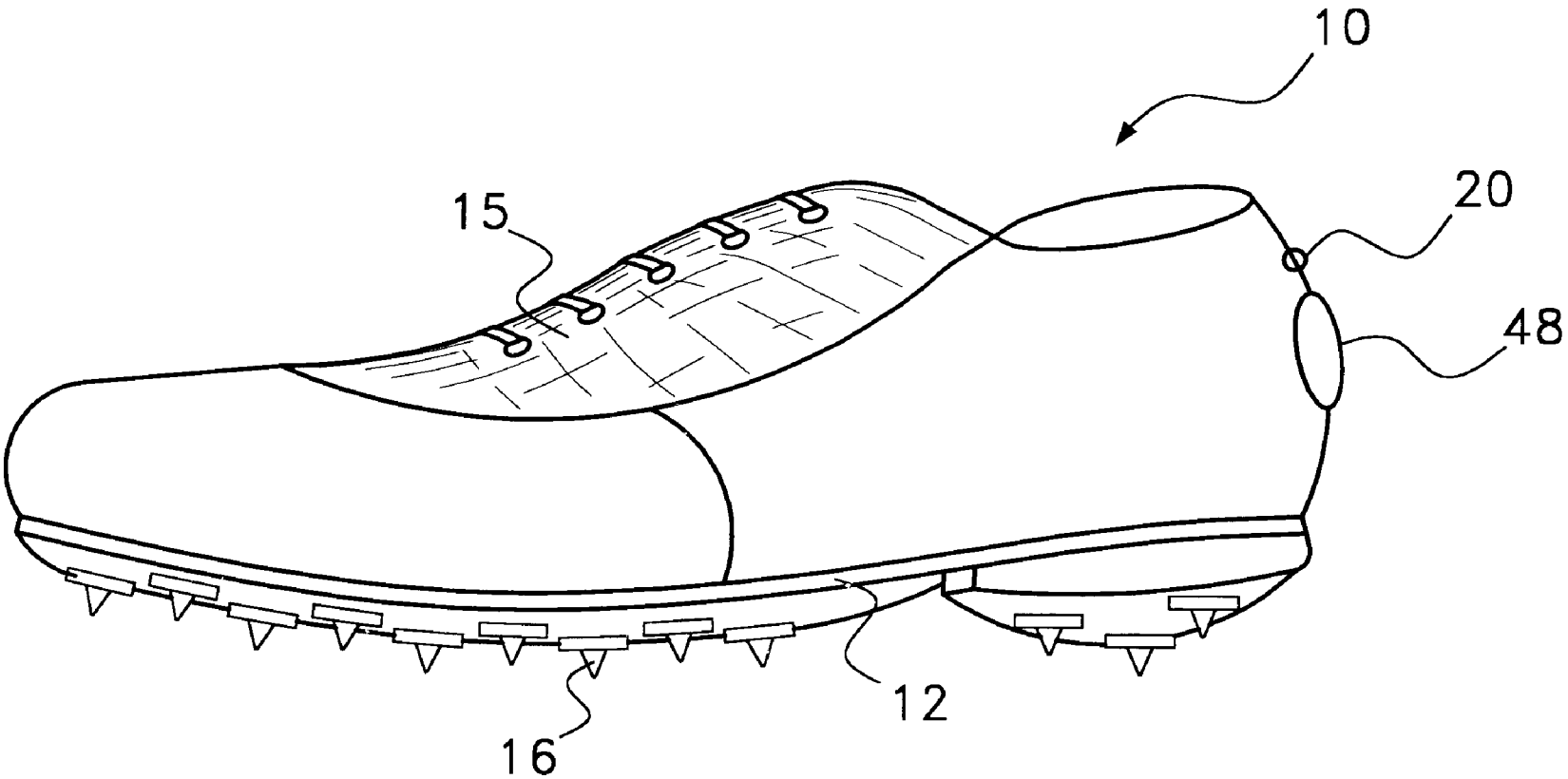
FIG. 1 is a side view of a golf shoe in accordance with the present invention.

Referring to FIG. 1, there is shown an embodiment of a golf shoe 10. The golf shoe 10 has a sole 12 and an upper section 14 that is sized and shaped to receive a person's foot. The upper section 14 is of a standard construction and is made of leather, canvas or another typical shoe material. However, the area 15 of the upper section of the golf shoe 10 near the laces can be made of an elastic material. The presence of the elastic material allows a foot to move upwardly within the confines of the golf shoe 10 without discomfort, as will later be explained. Cleats 16 extend from the bottom of the sole 12, thereby making the shoe 10 a proper regulation golf shoe.

Part of what is unique about the golf shoe 10 is the use of an internal bladder that causes a foot within the golf shoe 10 to tilt inwardly. By tilting the foot inwardly, the shoe 10 causes a right-handed golfer to place his/her weight on the inner side of their right foot, which is traditionally proper during a golf swing.

The bladder within the golf shoe 10 is selectively inflated using a pump bellows 18, which is manufactured into the structure of the shoe 10. The pump bellows 18, in the shown embodiment, is formed to look like a golf ball. However, many differently sized and shaped pump bellows can be substituted in its place and stead.

As the pump bellows 18 is pumped, air is forced into the bladder within the golf shoe 10. The bladder tilts the foot so that a right-handed person is forced to place their weight on the inside portion of their right foot. Thus, the shoe 10 helps a golfer use the proper stance when making a golf swing. Once the golf swing is over, the internal bladder is deflated, so that the shoe 10 holds the foot flat when walking. The bladder is deflated by selectively opening a vent valve 20 present on the exterior of the golf shoe 10.

Figure 2:
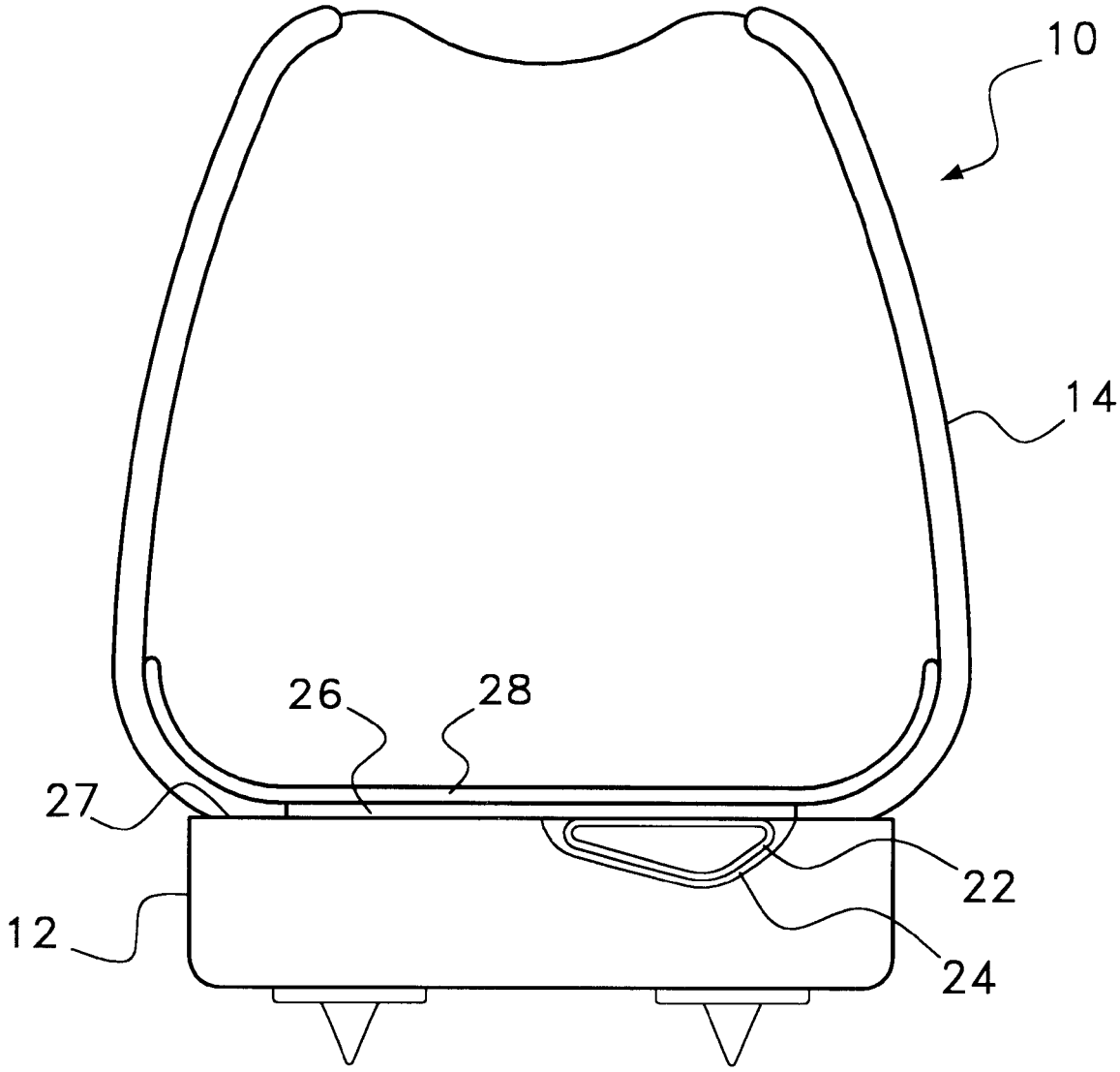
FIG. 2 is a cross-sectional view of the embodiment of the golf shoe shown in FIG. 1, wherein an internal bladder is not inflated.

Referring to FIG. 2, a first embodiment of the golf shoe 10 is shown. In this embodiment, it can be seen the sole 12 of the shoe 10 and the upper section 14 of the shoe 10 join together along a common interface seam 27. A pneumatic bladder 22 is positioned in the golf shoe 10 just below the interface seam 27. A shaped depression 24 is formed in the sole of the shoe 10. The shaped bladder 22 has a wedge shape. However, the wedge shape is formed with its deepest point near the edge of the sole 12 and its narrowest point near the center of the sole 12. This shape minimizes stresses in the pneumatic bladder 22 when the bladder is inflated. The bladder 22 and shaped depression 24 are positioned under the right side of the shoe 10. However, it will be understood that for a left-handed player, the bladder and depression would be positioned under the left side of the shoe.

A cover plate 26 is positioned over the shaped depression 24 and the bladder 22. The cover plate 26 expands over the shaped depression 24. The cover plate 26 can be made of plastic, metal or any other material that prevents the collapse of the cover plate 26 into the shaped depression 24 under the weight of a person's foot.

A cushioned insert 28 is positioned over cover plate 26. The cushioned insert 28 is made of material having elastic properties. As such, the cushioned insert 28 can be made of an elastomeric material.

The presence of the cover plate 26 and the cushioned insert 28 serves two purposes. First, the cover plate 26 and cushioned insert 28 prevent a person's foot from directly contacting the bladder 22. This prevents the bladder from becoming prematurely worn by chafing against a person's moving foot or sock. Secondly, the presence of the cover plate 26 and the cushioned insert 28 prevents a person's foot from collapsing into the shaped depression 24 when the bladder 22 is deflated. Accordingly, when the bladder 22 is deflated, as is shown in FIG. 2, the cushioned insert 28 lays flat within the shoe 10 and the shoe 10 functions as would any other golf shoe. Any foot placed in the golf shoe 10 would lay flat within the shoe 10. The golf shoe 10 is therefore appropriate for the large amount of walking typically required within the game of golf.

Figure 3:
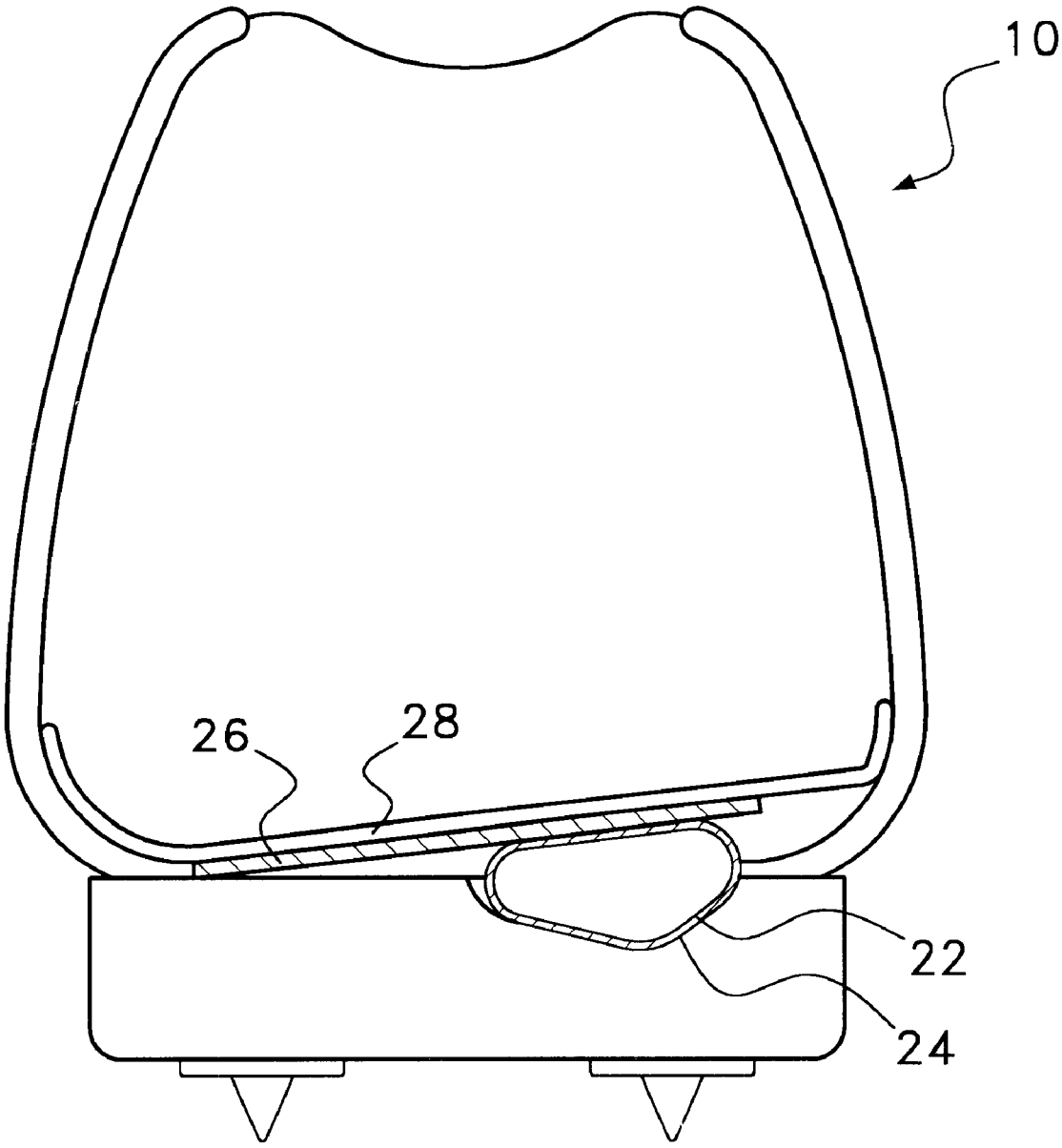
FIG. 3 is a cross-sectional view of the embodiment of the golf shoe shown in FIG. 1, wherein an internal bladder is inflated.

Referring to FIG. 3, it can be seen that as the bladder 22 is inflated, the bladder 22 displaces the cover plate 26, thereby causing the cover plate 26 to be tilted at an angle. The tilting of the cover plate also causes the cushioned insert 28 to slant. As such, any foot present within the shoe 10 would slanted inwardly. The bladder 22 therefore has the same effect on the foot as would an external wedge placed under the right side of the shoe. The elastic area 15 (FIG. 1) in the upper portion 14 of the shoe, enables the foot to slant within the golf shoe 10 without discomfort.

The configuration of the shaped depression 24 is a mirror image of the shape of the wedge created by the bladder 22. In this manner, the compression stresses applied to the bladder 22 are minimized and the bladder 22 will not rupture if over inflated or over compressed.

To utilize the golf shoe 10, a golfer walks around with the bladder 22 deflated (FIG. 2) until the golfer is ready to strike a golf ball. Prior to swinging a club, a golfer reaches down to his/her shoe and inflates the bladder using the pump bellows 18 (FIG. 1) on the exterior of the golf shoe 10. The golfer then swings with the advantage of having the golf shoe 10 bias their weight onto the interior of their right foot. After the golf swing is complete, a golfer opens the vent valve 20 (FIG. 2) and deflates the bladder 22. The golfer is then free to walk on the golf course to the next shot in the normal fashion. As a consequence, nothing but air has to be added or removed from the shoe 10 in order to covert the shoe from a normal walking shoe and a golf swing aid.

Figure 4:
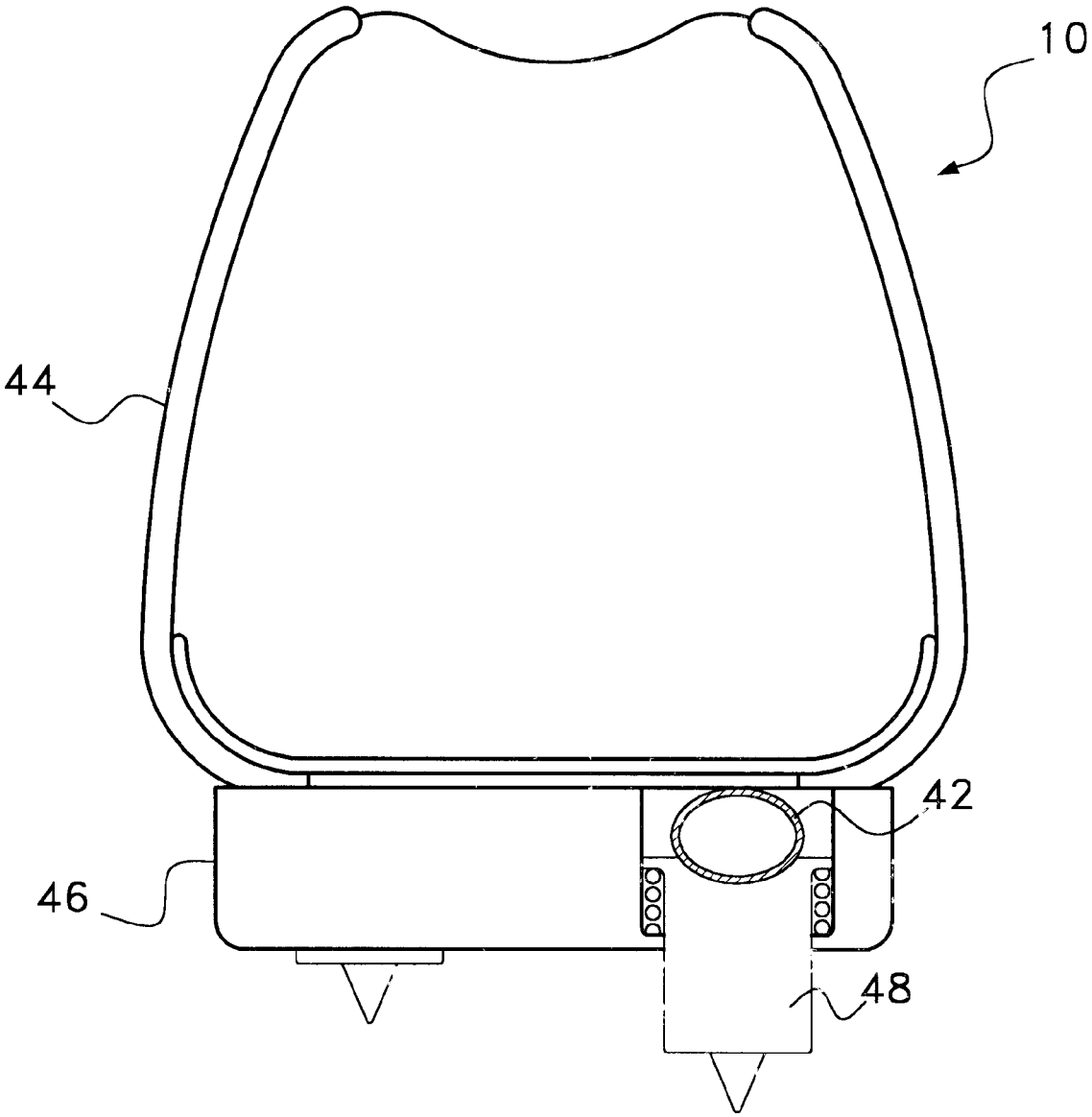
FIG. 4 is a cross-sectional view of an alternate embodiment of a golf shoe containing the present invention.

Referring to FIG. 4, an alternate embodiment of the present invention shoe device 40 is shown. In this embodiment, a bladder 42 is present in the structure of the golf shoe 40. However, the bladder 42 does not act to change the orientation of the shoe's upper section 44 with respect to the shoe's sole 46. Rather, when inflated, the bladder 42 drives at least one spacer 48 down from the sole 46 toward the ground. The presence of the spacer(s) 48 elevates one side of the shoe 40. The result is that the spacer(s) 48 tilt the golf shoe 40 to one side, thereby causing a right handed golfer to keep his/her weight on the inside half of his/her right foot. The spacer(s) 48 therefore have the same effect on the foot as would an external wedge placed under the right side of the shoe.

To utilize the golf shoe 40, a golfer walks around with the spacer 48 withdrawn until the golfer is ready to strike a golf ball. Prior to swinging a club, a golfer reaches down to his/her shoe and extends the spacer 48 using the pump bellows 18 (FIG. 1) on the exterior of the shoe 40. The golfer then swings with the advantage of having the golf shoe 40 bias their weight onto the interior of their right foot. After the golf swing is complete, a golfer opens the vent valve 20 (FIG. 1) and retracts the spacer 48. The golfer is then free to walk on the golf course to the next shot in the normal fashion.

It will be understood that the embodiments of the present invention shoe device are merely exemplary and do not represent all embodiments intended to be included by the scope of this disclosure. A person skilled in the art can vary the embodiments of the invention described by using functionally equivalent components in a variety of different shapes, sizes and orientations. All such alternate embodiments and modifications of the described invention are intended to be included in the scope of the invention as defined by the appended claims. Furthermore, it will be understood that the shown embodiments show the present invention applied to a right shoe for use by right-handed golfers. The present invention can also be applied to left shoes for left-handed golfers, wherein the present invention tilts a left shoe from left right to left in the same manner as was described.

What is claimed is:

1. A shoe device comprising:

an upper shoe section sized and configured to receive a person's foot therein;

a sole section joined to said upper shoe section along an interface seam, said sole section having a top surface, a bottom surface and a shaped depression disposed between said top surface and said bottom surface below said interface seam, wherein said top surface and said bottom surface are both definable by two sides, which are a right side and a left side;

a pneumatic bladder disposed within said shaped depression within said sole section, said pneumatic bladder having an inflated state and a deflated state, wherein, while in said inflated state, said pneumatic bladder causes one of said two sides of said top surface of said sole section to deform along said interface seam and protrude into said upper shoe section, thereby creating an uneven surface within said shoe device upon which a person's foot would rest while wearing said shoe device.

2. The device according to claim 2, further including a pump disposed on said upper shoe section for selectively inflating said pneumatic bladder.

3. The device according to claim 2, further including a vent valve disposed on said upper shoe section for selectively deflating said pneumatic bladder.

4. The device according to claim 1, wherein said shaped depression has a wedge shape, whereby the depth of said shaped depression decreases as said shaped depression approaches the center of said sole section.

5. The device according to claim 4, further including a cushioned insert disposed within said upper shoe section, wherein said cushioned insert lays over said cover plate.

6. The device according to claim 1, further including a cover plate for covering said shaped depression when said pneumatic bladder is in said deflated state, wherein said cover plate lies flat along said interface seam when said pneumatic bladder is in said deflated state, and is displaced into a slanted orientation when said bladder is in said inflated state.

7. The device according to claim 1, wherein said upper shoe section contains an elastic region that can expand when a persons foot is elevated in said shoe by said pneumatic bladder.

* * * * *